US011988086B2

(12) United States Patent
Winkel

(10) Patent No.: US 11,988,086 B2
(45) Date of Patent: May 21, 2024

(54) METHOD AND DEVICE FOR CONTROLLED FILLING AND INSPECTION OF BLAST HOLES

(71) Applicant: indurad GmbH, Aachen (DE)

(72) Inventor: Reik Winkel, Aachen (DE)

(73) Assignee: indurad GmbH, Aachen (DE)

( * ) Notice: Subject to any disclaimer, the term of this patent is extended or adjusted under 35 U.S.C. 154(b) by 223 days.

(21) Appl. No.: 17/210,708

(22) Filed: Mar. 24, 2021

(65) Prior Publication Data

US 2021/0310780 A1 Oct. 7, 2021

(30) Foreign Application Priority Data

Mar. 24, 2020 (EP) ..... 20165157

(51) Int. Cl.
*E21B 47/04* (2012.01)
*E21B 47/047* (2012.01)
(Continued)

(52) U.S. Cl.
CPC ..... *E21B 47/085* (2020.05); *E21B 47/04* (2013.01); *E21B 47/047* (2020.05); *E21B 47/08* (2013.01);
(Continued)

(58) Field of Classification Search
CPC ..... F42D 1/08; F42D 1/10; F42D 3/04; E21B 47/04; E21B 47/047; E21B 47/085; E21B 47/08
See application file for complete search history.

(56) References Cited

U.S. PATENT DOCUMENTS 11,119,241 B2 * 9/2021 Øy ..... G01S 13/0209
11,340,379 B2 * 5/2022 Likins, Jr. ..... E21B 47/085
(Continued)

FOREIGN PATENT DOCUMENTS

CN 105300206 A 10/2015
CN 105300206 A * 2/2016 ..... F42D 1/08
(Continued)

OTHER PUBLICATIONS

Machine Translation of CN105300206 (Year: 2016).*
Machine Translation of CN107992098 (Year: 2018).*
European Search Report in EP 20165157 (Year: 2020).*
European Opinion in EP 20165157 (Year: 2020).*
English translation of claims in EP 20165157 as amended on Mar. 7, 2021 (Year: 2021).*

*Primary Examiner* — James S Bergin
(74) *Attorney, Agent, or Firm* — DINSMORE & SHOHL LLP

(57) ABSTRACT

A method and apparatus for controlled charging of blasting boreholes with a flowable/pourable explosive, in particular in open-cast mining, includes: providing a radar head with at least one radar unit operated in a non-rock penetrating frequency range; arranging the radar head on a pulling element; introducing the radar head into the borehole in that the radar head is lowered into the blasting borehole in an arrangement at the pulling means from an upper aperture opening of the blasting borehole; and detecting at least one measurement value comprising a base distance of the radar head from the blasting borehole base and/or a charge level distance to determine the charge level of the explosive in the blasting borehole; and/or comprising the shape of the jacket section over at least a portion of the depth of the blasting borehole by means of the operation of at least one of the radar units.

8 Claims, 4 Drawing Sheets

(51) Int. Cl.

| | |
|---|---|
| ***E21B 47/08*** | (2012.01) |
| ***E21B 47/085*** | (2012.01) |
| ***E21B 47/26*** | (2012.01) |
| ***F42D 1/10*** | (2006.01) |
| ***F42D 3/04*** | (2006.01) |
| *E21B 7/00* | (2006.01) |
| *E21B 47/01* | (2012.01) |
| *E21B 47/024* | (2006.01) |
| *E21B 47/09* | (2012.01) |

(52) U.S. Cl.
CPC ..... *E21B 47/26* (2020.05); *F42D 1/10* (2013.01); *E21B 7/007* (2013.01); *E21B 47/01* (2013.01); *E21B 47/024* (2013.01); *E21B 47/09* (2013.01); *E21B 2200/20* (2020.05)

(56) References Cited

U.S. PATENT DOCUMENTS

| | | | | |
|---|---|---|---|---|
| 2011/0006585 | A1* | 1/2011 | Holdcroft | F42D 5/00 299/13 |
| 2021/0310349 | A1* | 10/2021 | Loveland | E21B 7/007 |

FOREIGN PATENT DOCUMENTS

| | | | | |
|---|---|---|---|---|
| CN | 107992098 | A | 11/2017 | |
| CN | 107992098 | A * | 5/2018 | F42D 1/08 |
| WO | 2014/063188 | A1 | 10/2013 | |
| WO | WO-2013149308 | A1 * | 10/2013 | E21B 47/0002 |
| WO | WO-2014063188 | A1 * | 5/2014 | F42D 1/10 |

* cited by examiner

METHOD AND DEVICE FOR CONTROLLED FILLING AND INSPECTION OF BLAST HOLES

CROSS REFERENCE TO RELATED APPLICATION

This application claims priority to European Application No. 20 165 157.7 filed Mar. 24, 2020, the entire content of which is incorporated herein by reference.

FIELD OF THE INVENTION

The invention relates to a method and to an apparatus for the controlled charging of blasting boreholes with a flowable or pourable explosive, in particular in open-cast mining for the blasting of excavation volumes.

BACKGROUND OF THE INVENTION

US 2011/0006585 A1, for example, discloses a method for the inspection of blasting boreholes in open-cast mining to detect the condition of the blasting borehole so that a decision can be made in dependence on the condition whether the explosive is filled into the blasting borehole. The condition in this respect in particular relates to the temperature of the blasting borehole, above all in deeper regions, to avoid the blasting borehole having too high a temperature, in particular in the lower half, whereby the risk of premature and uncontrolled firing of the explosive arises when it is charged. In this process, the temperature in the lower region of the blasting borehole should be measured by a sensor in that the sensor is lowered into the blasting borehole at a cable to ultimately determine the temperature. The sensor should here in simplified terms be designed with the actual detonator that is anyway lowered into the blasting borehole.

A method for the controlled charging of blasting boreholes with a flowable or pourable explosive is known from WO 2014/063188 A1, which takes place in a variety of arrangements in the sector of open-cast mining to blast larger excavation regions with a plurality of blasting boreholes and to subsequently remove them. To charge the blasting borehole, an apparatus is provided that comprises a vehicle and a means for charging the blasting borehole is present at the vehicle and has a boom arm and at the end of the boom arm there is a charging spout that is by way of example arranged below the vehicle and that can be traveled closely above the aperture opening of the blasting borehole. The flowable or pourable explosive, for instance ammonium nitrate and diesel, so-called ANC or ANO explosives, can subsequently be moved directly into the blasting borehole via the charging spout.

A sensor is located at the charging spout itself and is intended for the depth measurement of the blasting borehole; it can in particular also be determined by the sensor whether there is any water in the blasting borehole. The sensor is here in a fixed arrangement at the charging spout and can, for example, comprise a laser sensor or a radar sensor.

However, disadvantageously, typical blasting borehole depths and curvatures are so large that a reliable radar measurement is no longer possible due to the Fresnel zone required for the propagation of the radar waves.

The charging of blasting boreholes with explosive is a relevant workstep for open-cast mining that is decisive for a desired blasting result. If the blasting borehole, for example, does not have the desired approximately cylindrical geometry, caused by resulting lateral chips in the jacket section of the blasting borehole, which is caused by the falling of broken material into the blasting borehole or by the running in of water, the charging can frequently not take place as is required for a desired blasting result.

If, for example, larger material volumes are present in the lower region of the blasting borehole, for example due to chips from the side walls, there will be too much explosive present in too great a depth of the blasting borehole on a charging of the blasting borehole with a specified constant quantity of explosive and the region of the blasting borehole closer to the surface has no or too little explosive. As a result, large, non-detached material pieces are produced form the volume formation that have to be subsequently comminuted in a laborious manner, for example by mudcapping or by a hydraulic hammer.

It can equally occur that due to the falling of broken material into the blasting borehole too little explosive is charged in the deeper region of the blasting borehole and too much explosive is charged into the upper region of the blasting borehole with a constant filling quantity. As a result, an escaping of blasting energy from the upper-side aperture opening is produced on a firing so that ultimately a satisfactory blasting result is also not achieved in this case since non-detached material regions that are too large remain at a greater depth of the blasting field. A laborious subsequent comminution is also necessary here that is expensive and time intensive.

As a result, an exact charging of the blasting borehole for an optimum blasting is in particular necessary in a required distribution over the depth of the blasting borehole, which cannot be ideally ensured with previous means.

SUMMARY OF THE INVENTION

The object of the invention is the further improvement of a method for the controlled charging of blasting boreholes with a flowable or pourable explosive and the provision of an apparatus for this purpose, wherein very deep holes having a small diameter can also be charged in the required manner by the method to ensure the required distribution of the explosive over the vertical extent of the blasting borehole.

This object is achieved by the respective characterizing features starting from a method as disclosed herein and starting from an apparatus as disclosed herein and starting from a radar head as disclosed herein. Advantageous further developments of the invention are also disclosed.

The following steps are provided in accordance with the invention with respect to the method: Providing a radar head having at least one radar unit that is operated in the non-rock penetrating frequency range; arranging the radar head at a pulling means; introducing the radar head into the blasting borehole in that the radar head is lowered into the blasting borehole in an arrangement at the pulling means from an upper aperture opening of the blasting borehole; and detecting at least one measurement value comprising a base distance of the radar head from the blasting borehole base and/or a charge level distance to determine the charge level of the explosive in the blasting borehole; and/or comprising the shape of the jacket section over at least a portion of the depth of the blasting borehole by means of the operation of at least one of the radar units.

The central idea of the invention is the detection of the absolute charge level of the explosive in the blasting borehole, in particular above the blasting borehole bottom, and since the detection of the charge stream of the explosive from the apparatus, in particular from a corresponding container of the apparatus, into the blasting borehole is anyway detected and monitored by the apparatus for charging the blasting borehole with explosive, the charge level of the explosive in the blasting borehole detected or monitored during the charging can be determined, that is what amount of explosive is located at what level above the blasting borehole bottom in the blasting borehole. The determination of the charge level takes place in that the substantially vertical distance of the radar head above the charge level of the explosive is measured and a calculation back to the charge level of the explosive in the blasting borehole can subsequently be carried out. The frequency range in which the at least one radar unit is operated is preferably above 3 GHz. A substantial advantage in the avoidance of the use of a ground penetrating radar (GPR) is the higher frequency since the construction dimensions of the radar unit having the associated antenna can thus also be configured as smaller, which is advantageous for the use of a radar in accordance with the invention since the latter should preferably be lowered into the borehole and small dimensions are thus advantageous.

Corresponding data for a controlled charging of blasting boreholes with explosive can thus be detected and provided, in particular to monitor the apparatus for charging the blasting borehole, and as a result to establish the required distribution of explosive over the height in the blasting borehole so that the subsequent blasting can be carried out with a correspondingly good result.

The radar head is configured in accordance with the invention, for example, only to detect the charge level, from which a one-dimensional (1D) distance measurement is produced, for instance in the Z axis (vertical axis). If the jacket section of the blasting borehole is detected by means of a 1D point measurement or by means of one or more 2D section measurements, a two-dimensional (2D) measurement (X and Y axes) results; and with the combined detection of the height position, a three-dimensional (3D) measurement (X, Y, and Z axes) results.

The size of the radar head is designed such that it can be introduced into a blasting borehole of a typical diameter for blasting in open-cast mining. The blasting borehole extends perpendicular or at an angle of inclination to the perpendicular to carry out the method in accordance with the invention. The radar head can thus be lowered at the pulling means into the blasting borehole due to gravity, either centrally through the blasting borehole or the radar head slides along the borehole wall and into the blasting borehole when it is placed at an angle of inclination. Typical blasting borehole diameters are in the range between 10 cm and 50 cm and have a depth of, for example, up to 100 m. The radar head consequently has a diameter that is smaller than the smallest diameter of a blasting borehole that is to be inspected.

The pulling means can be formed by means of a rope, in particular a steel wire rope, a belt, a chain, or a rod, with the pulling means preferably further comprising an electric cable to operate the at least one radar unit at the radar head and to transmit data from the radar unit, for example to a computer unit that is arranged at the apparatus for carrying out the method, for example at a vehicle that also stores the explosive. In the sense of the invention, the pulling means consequently forms the totality of the electric cable and a force-absorbing part.

The radar head is moved either from bottom to top or from top to bottom between a lower blasting borehole base and the aperture opening of the blasting borehole during the detection of the at least one measurement value. If the blasting borehole is charged with explosive, the radar head is preferably moved from the bottom to the top starting from the blasting borehole base up to the aperture opening. The movement can take place via a retraction of the pulling means, for example via a winch or the like. The winch or the like is here located in or at the apparatus, in particular at the vehicle, that is traveled to the blasting borehole to carry out the method for the controlled charging of the blasting borehole with explosive.

It is important for the detection of the charge level of the explosive in the blasting borehole, but also for the detection of the shape of the jacket section of the blasting borehole, to determine the height position of the radar head along the vertical axis. Provision is, for example, made for this purpose that the pulling means is guided at least indirectly via at least one rotary encoder or length encoder, with the position of the radar head along the vertical axis being detected by the rotary encoder or length encoder and being output as height information. The height information can then be transmitted to the computer unit and be put into relation with the quantity of explosive already placed into the blasting borehole since the height information that is output by the rotary encoder or length encoder can be traced back to the charge level of the explosive in the blasting borehole, in particular since the position is known in which the radar head has already been pulled up starting at the blasting borehole base and since how much absolute quantity of the explosive that has already been placed in is known.

If measurement values relating to the shape of the jacket section of the blasting borehole are detected, these measurement values can likewise be correlated with the height information output by the rotary encoder or length encoder so that the blasting borehole can be represented completely with respect to the topography of the inner jacket profile, for example as a model on a screen of the computer unit.

Alternatively or additionally to a rotary encoder or length encoder via which the pulling means is guided, the radar head can comprise at least one radar unit by which distance information can be provided by means of a radar-based position determination process, with the position of the radar head along the vertical axis being detected by the radar-based position determination method and being output as height information by the radar head. The position determination process can, for example, relate to a simultaneous localization and mapping process, with there also being the possibility of using a radar-based Doppler method. The height information is here in particular tapped by the inner surface of the jacket section of the blasting borehole in that the radar head has at least one corresponding radar unit for this purpose.

The at least one radar unit in an arrangement at the radar head can relate to an autonomously operating radar unit or can also already only be formed by a radar antenna in the sense of the invention.

There is advantageously the possibility within the framework of the invention to use a gyroscope as a component of the radar head. Gyroscopes serve the determination of the pose of an object in space and if the gyroscope is designed as a construction unit with the radar head, the possibility advantageously results of detecting the pose of the radar head in the blasting borehole by the gyroscope. These data can then, for example, be documented together with the data detected by the radar units and can be transmitted in a wired or wireless manner to a computer unit. In this respect, there is the advantageous possibility within the framework of a further development of a radar head in accordance with the invention having an integrated gyroscope to combine the data detected by the radar units with the data that are detected by the gyroscope. The gyroscope can, for example, provide height information or can detect a lateral deviation from the perpendicular while providing a direction vector that is combined with the information of one or more radar units to form a topography of the jacket section of the borehole.

The measurement values detected by the radar head comprising the charge level of the explosive in the blasting borehole and/or the shape of the jacket section over at least a portion of the depth of the blasting borehole is preferably communicated to a computer unit, with a charge amount or a charge stream of the explosive that is placed into the blasting borehole being determined on the basis of the determined measurement value. Information can then either be communicated to an operator on how and in what amount at which time the explosive has to be placed into the blasting borehole, for example by additional amounts or by reductions. The method can also be carried out in an automated manner in that the computer unit controls a corresponding conveyor rate of the explosive, for example via a conveyor module in the vehicle of the apparatus.

The radar head has a radar unit to carry out the method by which the distance of the radar head above the charge level of the explosive is measured, from which the height information of the charge height in the blasting borehole is determined and output in conjunction with a determined position of the radar head along the vertical axis. For this purpose, the radar unit is located at the lower side of the radar head that faces in the direction toward the already charged explosive. Provision can also be made that the radar head has a rotary unit for a 2D section measurement by which at least one radar beam of at least one 1D radar unit is rotatable about the vertical axis so that an X/Y section is mapped on which the vertical axis Z in particular forms a surface normal.

The detection of the charge level of the explosive in the blasting borehole particularly advantageously takes place during the charging of the blasting borehole with explosive. The explosive can consequently be placed into the blasting borehole and in real time and simultaneously the amount of explosive placed in is monitored by the method in accordance with the invention such that what amount of explosive is located at what depth in of the blasting borehole is known at all times.

If the blasting borehole is at least partially filled with water, then in accordance with an advantageous further development of the invention, at least one ultrasound sensor can be present at the radar head that in particular operates as an echosounder so that a detection of the charge level of the explosive in the blasting borehole and/or a detection of the shape of the jacket section of the blasting borehole can take place over at least a portion of the depth of the blasting borehole. In accordance with an alternative, at least one radar unit or all the radar units can thus also be replaced by at least one ultrasound sensor or echosounder at the radar head.

The speed of fall of particles forming the explosive or of a fluid when a fluid explosive is uses can further advantageously be detected by the radar head during the charging of the blasting borehole with explosive. Further information can be derived from this, for example whether the particles are in free fall or, for example, what density the charged explosive has. The detection of the speed of fall of the particles forming the explosive by means of the at least one radar unit is in particular based on the use of the Doppler effect.

The method particularly advantageously comprises the step of generating a 3D blasting borehole model by the computer unit based on the determined measurement values comprising the shape of the jacket section over at least a portion of the depth of the blasting borehole. The detection of the measurement values relating to the shape of the jacket section can here preferably take place before the charging of the blasting borehole with explosive so that a blasting borehole model is first prepared to subsequently determine at what speed over the charge time and in what amount explosive can be placed into the blasting borehole.

The object of the invention is further achieved by an apparatus for the controlled charging of blasting boreholes with a flowable or pourable explosive, in particular in open-cast mining, with the apparatus comprising means for charging the blasting borehole. In accordance with the invention, the apparatus here furthermore has a radar head having at least one radar unit that is operable in the non-rock penetrating frequency range; the apparatus further comprises a pulling means at which the radar head is arranged and can be lowered into the blasting borehole, and with the radar head comprising the following: at least one radar unit for detecting a charge level of the explosive in the blasting borehole along a vertical axis and/or at least one radar unit for detecting the shape of the jacket section over at least a portion of the depth of the blasting borehole.

The means for charging the blasting borehole can comprise a covering tube, with the pulling means being led through the covering tube and the radar head being led out of a lower end of the covering tube and being lowerable into the blasting borehole. In accordance with an advantageous embodiment, it is also conceivable that the pulling means is formed by the covering tube itself so that the radar head is fastened to the covering tube and is let into the blasting borehole together with the covering tube. The covering tube through which the explosive can simultaneously be led can then be let out and retracted in variable lengths.

The means for charging the blasting borehole can moreover comprise a rotary encoder or a length encoder, with the pulling means being guided at least indirectly via the rotary encoder or length encoder so that the position of the radar head along the vertical axis can be detected by the rotary encoder or length encoder.

The apparatus can furthermore comprise a computer unit by which a charge amount of the explosive that is placed into the blasting borehole can be determined and/or a 3D model of the blasting borehole can be prepared on the basis of the determined measurement values.

If a 3D model is prepared, this can take place before the actual charging of the blasting borehole to make a decision for a later charging of the of the blasting borehole whether it is generally suitable, that is, for example too large or too small, or whether the blasting borehole has to be reworked, for example if the substrate releases from the hole wall and falls down to the base of the hole and covers it at least partially again in an unwanted manner.

A simulation program operable on a computer unit can consequently be fed with data that are acquired by the inspection of blasting boreholes in accordance with the invention. As a result, a 3D hole model can thus be generated, for example, that can be used as the basis for the later charging of the blasting borehole with explosive, in particular with respect to the charge amount, charging speed, and the like. It can thus be ensured in advance that the holes can be charged with the suitable amount of explosive without blasting boreholes also remaining too small after the charging so that the rock assembly to be detached is not comminuted. It can equally be avoided that blasting boreholes do not become too large since the blasting force is thus too great and the risk of stone throw increases.

The radar head further advantageously has a base body at which a connection means for a pulling means is formed at an upper side and at which a radar unit comprising a radar element and a radar lens is formed at a lower side. In accordance with a preferred embodiment, the base body in an arrangement at the side relative to a vertical axis has at least one radar unit by which the shape of the jacket section can be detected or by which a position determination of the radar head can in particular be determined along a vertical axis in the blasting borehole.

The radar head further advantageously has a bell-like protective covering that is preferably made of plastic and that can be irradiated by radar waves. The protective covering here prevents any contact of the base body having the radar units arranged at the base body with the inner surface of the blasting borehole and in particular with the granular falling explosive since the radar head is pulled from bottom to top in the vertical direction through the blasting borehole during the charging. The protective covering can, for example, be closed toward the upper side and can be open in the manner of a bell toward the lower side and/or the protective covering closes tightly with a radar lens at the lower side of the radar head.

The radar head further advantageously has a centralizer by which the radar head is held approximately at the center of the blasting borehole cross-section. The centralizer can, for example, comprise a surface feel that is designed as spring arms and presses against the inner surface of the blasting borehole. Three, four, or more spring arms can, for example, be distributed over the periphery of the radar head.

BRIEF DESCRIPTION OF THE DRAWINGS

Further measures improving the invention will be shown in more detail below together with the description of a preferred embodiment of the invention with reference to the Figures. There are shown.

DETAILED DESCRIPTION OF THE INVENTION

Figure 1:
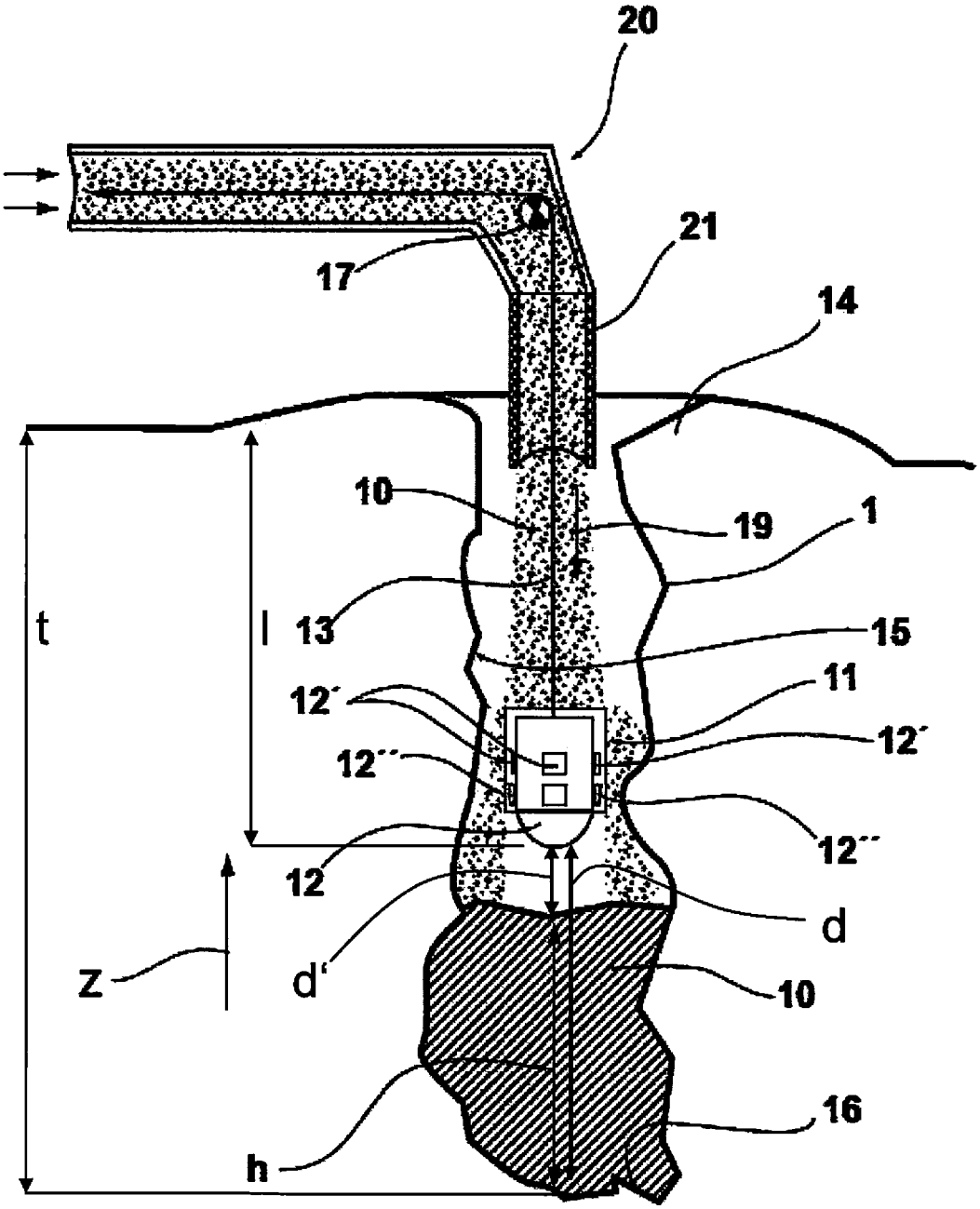
FIG. 1 is a cross-sectional view through a blasting borehole with a radar head let into the blasting borehole while the blasting borehole is charged with explosive.

FIG. 1 schematically illustrates a cross-sectional view of a blasting borehole 1 that extends downwardly in a vertical direction, for example, in a blasting field starting from an upper-side aperture opening 14 on a base surface of the blasting field down to a blasting borehole base 16. The blasting borehole 1 can be charged with explosive 10 starting from the blasting borehole base 16, with the illustration showing a lower part region of the blasting borehole 1 already charged with explosive 10 with a charge level h. The explosive 10 is charged into the blasting borehole 1 via means 20 for charging said blasting borehole 1, with the means 20 being arranged at a vehicle, for example.

A radar head 11, that can be lowered into the blasting borehole 1 to a lowering depth l is fastened to a pulling means 13 for this purpose and the pulling means 13 is led through a covering tube 21 that forms a lower part of the means 20 for charging the blasting borehole 1 with explosive 10. In this process, the pulling means 13 runs within the means 20 via a rotary encoder or length encoder 17 so that height information relating to the lowering depth l of the radar head 11 in the blasting borehole 10 is provided by the rotary encoder or length encoder 17. The radar head 11 is consequently located within the charge stream 19 of the explosive 10.

If the blasting borehole 1 is charged with explosive 10, a volume can be produced in dependence on the vertical axis z with a known constant charging rate of the blasting borehole 1 with explosive 10 due to the jacket section 15 of the blasting borehole 1 differing from a cylindrical shape, said volume differing from a simple cylinder volume of a cylinder when the borehole for forming the blasting borehole 1 having a jacket profile 15 differs from the purely cylindrical shape. The differences can, for example, be produced by material chips that arise during the drilling process to produce the blasting borehole 1 so that, with lateral pockets, bulges, and the like, additional volumes arise that are likewise charged with explosive 10, whereby a resulting charge level h is produced that cannot be directly determined by a simple measurement of the amount of explosive 10 placed into the blasting borehole 1.

The radar head 11 has radar units 12, 12', and 12", with the radar unit 12 serving the determination of the charge level h of the explosive 10 in the blasting borehole 1, starting from the blasting borehole base 16. For this purpose, the radar head 11 can first detect the base distance d without charged explosive 10 and the charge level distance d' from the charge level h can be detected by the radar unit 12 on the charging of explosive 10, with the charge level distance d' of the radar head 11 above the charge level h of the explosive 10 being able to be regulated by a corresponding regulating device so that the charge level distance d' of the radar head 11 above the charge level h remains constant. The current height position of the radar head 11 along the vertical axis z can then be determined by the rotary encoder or length encoder 17 to ultimately draw a conclusion on the amount of placed in explosive 10 in dependence on the determined height position of the radar head 11. The further radar units 12' and 12" will be explained in more detail in connection with the following FIG. 2.

Figure 2:
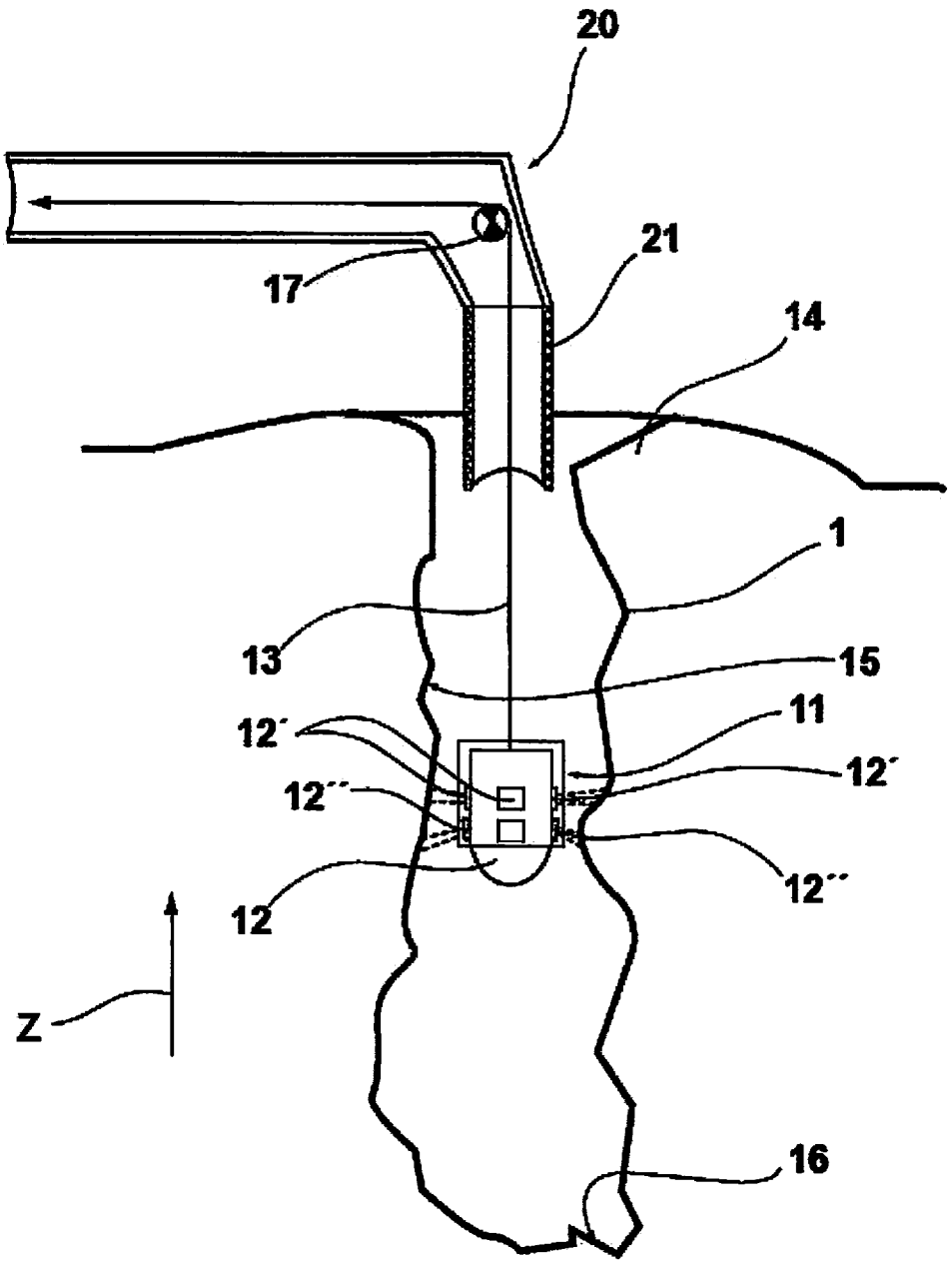
FIG. 2 is a cross-sectional view of a blasting borehole with a radar head let into the blasting borehole to detect the jacket section of the blasting borehole.

FIG. 2 shows a further cross-sectional view of a blasting borehole 1 with a radar head 11 that is lowered into the blasting borehole 1 before the charging of the blasting borehole 1 with explosive. The height position of the radar head 11 can here be determined by the rotary encoder or length encoder 17 in that the pulling means 13 is guided via the rotary encoder or length encoder 17, with the rotary encoder or length encoder 17 being integrated in the means 20 for charging the blasting borehole 1, and the pulling means 13 is guided, starting from the rotary encoder or length encoder 17, through the center of the covering tube 21 ultimately into the blasting borehole 1, for example.

The radar head 11 is, for example, first lowered into the blasting borehole 1 to the blasting borehole base 16. The radar head 11 at the pulling means 13 is subsequently pulled through the blasting borehole 1 with a constant movement from bottom to top up to the aperture opening 14 of the blasting borehole 1. In this process, the topography of the jacket section 15 of the blasting borehole 1 can be detected by activating the radar means 12' and the detected topography can be brought into correlation with the vertical axis z to ultimately detect height-dependent volume information of the blasting borehole 1 from this measurement. The further radar units 12" shown can here serve to likewise derive height information of the radar head 11 in the blasting borehole 1, for example in a SLAM (simultaneous localization and mapping) process, so that the information from the rotary encoder or length encoder 17 either becomes redundant or is replaced. A blasting borehole model can in particular then be produced by means of a computer unit using the data acquired to subsequently carry out the controlled charging of the blasting borehole 1 with explosive 10.

Figure 3:
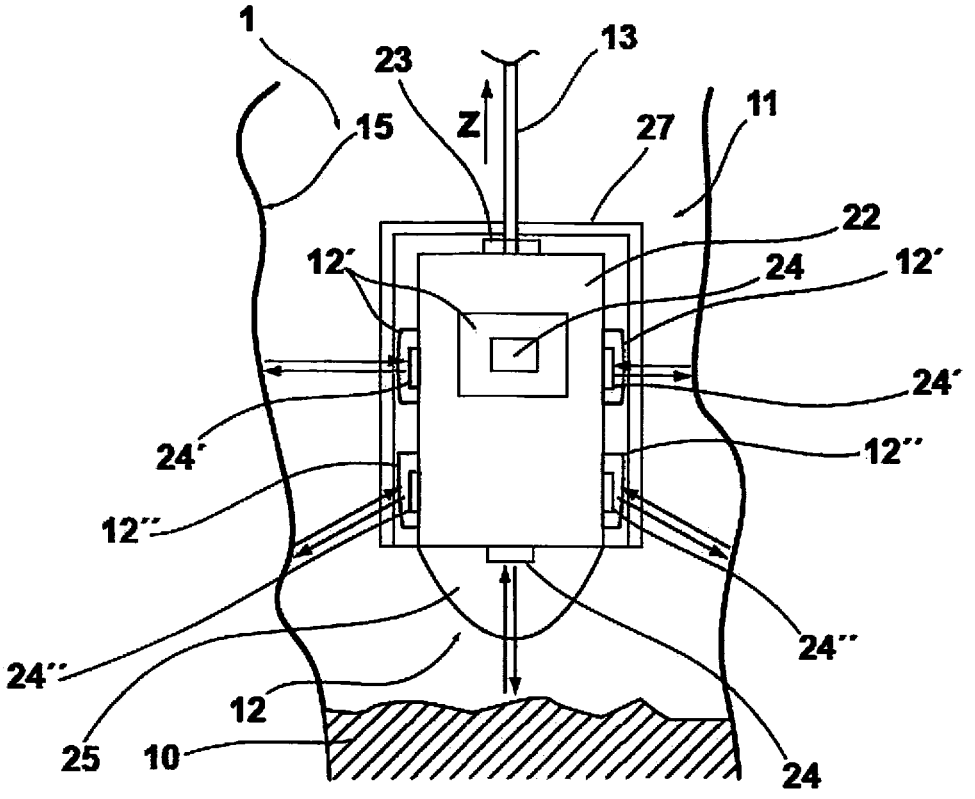
FIG. 3 is a schematic detail view of the radar head in an arrangement in the blasting borehole.

FIG. 3 shows a schematic detail view of the radar head 11 in an arrangement with a blasting borehole 10 that is charged up to a shown level with explosive 10. The radar head 11 has a base body 22 that is connected by a connection means 23 to the pulling means 13 and the position of the radar head 11 along the vertical axis z can be changed at the pulling means 13.

The radar head 11 comprises a plurality of radar units 12, 12', and 12" by way of example. The radar unit 12 is arranged at the lower side disposed opposite the pulling means 13 and can serve the determination of the distance from the charging level of the explosive 10. The radar unit 12 comprises a radar element 24 in an arrangement behind a radar lens 25 so that the charge level of the explosive 10 can be determined, with the charge level being derived by the known distance of the radar head 11 from the charge height and from the information on the height of the radar head 11 within the blasting borehole 1, for example output by the rotary encoder or length encoder 17 in accordance with FIG. 1 or FIG. 2.

The further radar units 12' have radar elements 24' by which the topography of the inner jacket section 15 of the blasting borehole 1 can be determined. In particular bulges, lateral pockets, and additional volumes in the blasting borehole 1 can thereby be detected.

The further radar unit 12" has radar elements 24" and the further radar units 12" serve the detection of the height information of the radar head 11 along the vertical axis z in the blasting borehole 1. The measurement by the radar units 12' is here based, for example, on a preferably radar-based position determination method, in particular on the application of the SLAM process with radar images or of the Doppler radar method.

If the radar head 11 is used while explosive 10 is placed into the blasting borehole 1, the radar head 11 is protected by a protective covering 27 as a component of the radar head 11 that surrounds the base body 22 having the radar units 12, 12', 12" at the outer side and thus protects it.

Figure 4:
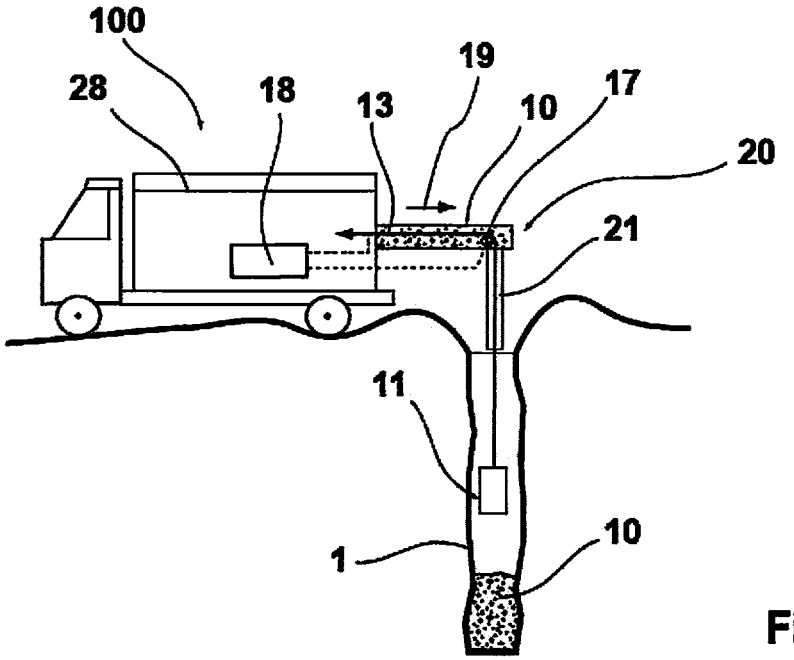
FIG. 4 is a schematic view of the apparatus with a vehicle, with means for charging the blasting borehole with explosive, and with a radar head that is lowered into the blasting borehole.

FIG. 4 shows a schematic view of an apparatus 100 with a vehicle 28 and the vehicle 28 has a container, not shown in more detail, as a substantial component in which the explosive is stored. Means 20 for charging a blasting borehole 1 with explosive 10 from the container in the vehicle 28 is furthermore arranged at the vehicle 28. The illustration furthermore shows a radar head 11 that is arranged at an end side at a pulling means 13. The pulling means 13 is led through the means 20 for charging the blasting borehole 1, in particular through a covering tube 21, and the radar head 11 can be pulled up and lowered in a manner not shown in any more detail, for example by a winch in or at the vehicle 28. The height of the radar head 11 within the blasting borehole 1 can thus be changed, with the height position of the radar head 11 in the blasting borehole 1 being able to be detected by a rotary encoder or length encoder 17 that is located at the means 20 for charging a blasting borehole 1.

A computer unit 18 is located by way of example in or at the vehicle and measurement values detected by the radar head 11 are transmitted to it, in particular in that the pulling means 13 can also comprise an electrical line in addition to a mechanical pulling means. Information of the rotary encoder or length encoder 17 can furthermore be transmitted to the computer unit 18 to likewise transmit the height position of the radar head 11 to the computer unit 18. The above-described method for the controlled charging of blasting boreholes 1 with a flowable or pourable explosive 10 can be carried out using the apparatus 1 shown.

Figure 5:
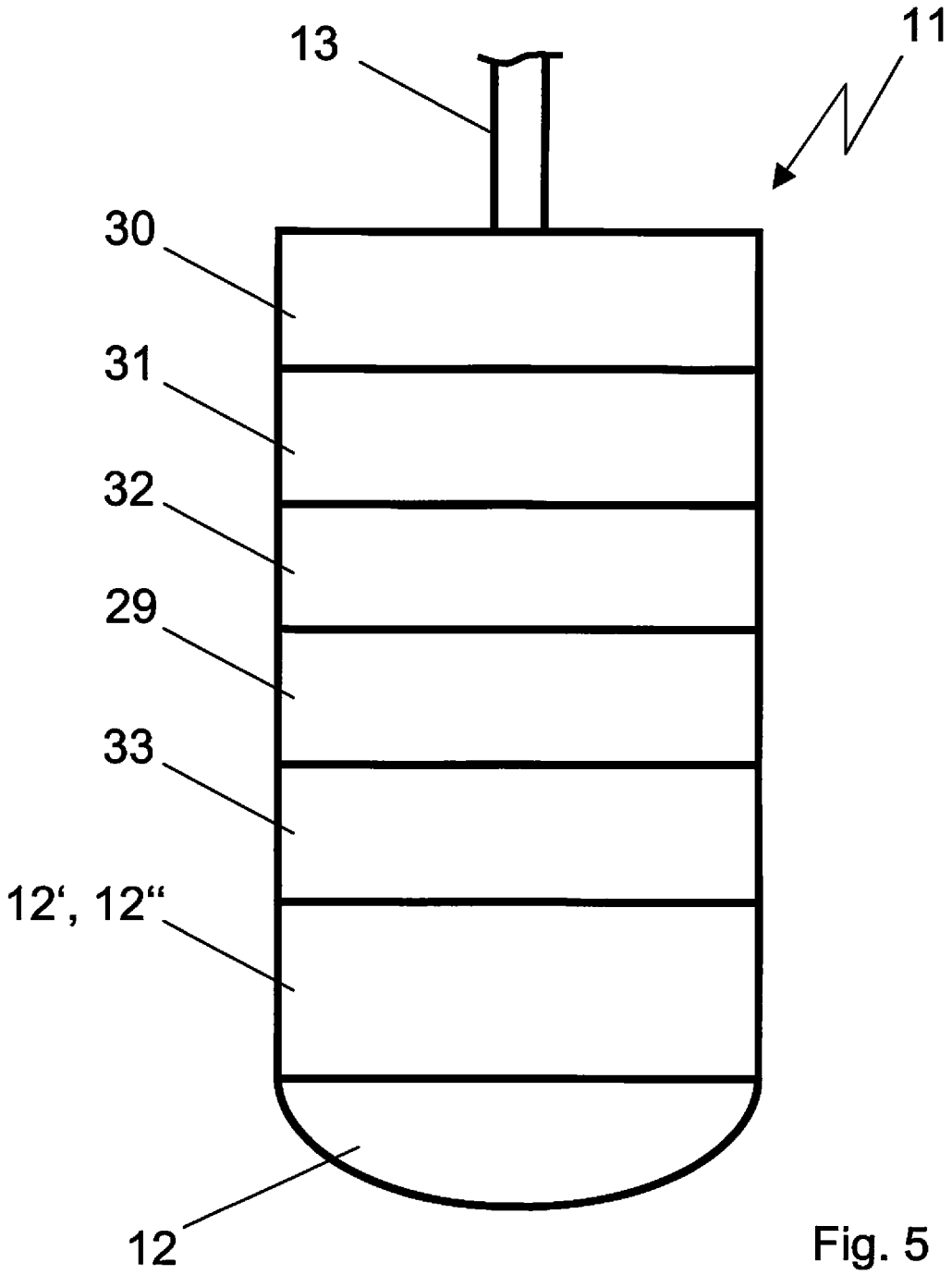
FIG. 5 is a schematic view of a radar head.

A further view of a radar head 11 is shown schematically in FIG. 5, with the illustration showing an embodiment of a radar head 11 in its advantageously selected components, with the list of the components not being exclusive and, in accordance with further embodiments, the components listed below also being able to be individually omitted without impairing the function of the radar head 11 in accordance with the invention.

The embodiment shows the radar head 11 in an arrangement at the pulling means 13 having a data store 30 in which measurement data can be stored that were detected, for example, by the radar units 12, 12', 12". An energy store 31 is furthermore shown as a component of the radar head 11 that is designed, for example, as a battery or as a rechargeable battery. A further component is an interface 32 for data communication, for example with the computer unit 18. A gyroscope 29 is additionally shown by which the pose of the radar head 11 within the blasting borehole can be detected. The data of the gyroscope 29 and also the data that can be detected by the radar units 12, 12', 12" can be stored in the data store 30.

Radar electrics 33 are furthermore shown that are required for the operation of the radar units 12, 12', 12". The radar units 12, 12', 12" located at the radar head 11 here, for example, only form the radar antennas and the electronics for operating the radar antennas are accommodated centrally in the radar head 11.

The invention is not restricted in its design to the preferred embodiment specified above. A number of variants is rather conceivable that also makes use of the solution shown with generally differently designed embodiments. All the features and/or advantages, including any construction details or spatial arrangements, originating from the claims, the description or the drawings can be essential to the invention both per se and in the most varied combinations. The radar head 11 can in particular also only have one or two of the three described radar units 12, 12', 12" so that it also only carries out a corresponding partial measurement, e.g. either the determination of the filling level h of the explosive 10 in the blasting borehole 1 or the topography of the inner jacket section 15 of the blasting borehole 1.

REFERENCE NUMERAL LIST

1 blasting borehole
10 explosive
11 radar head
12 radar unit
12' radar unit
12" radar unit
13 pulling means

14 aperture opening
15 jacket section
16 blasting borehole base
17 rotary encoder or length encoder
18 computer unit
19 charge stream
20 means for charging
21 covering tube
22 base body
23 connection means
24 radar element
24' radar element
24" radar element
25 radar lens
26 vertical axis
27 protective cover
28 vehicle
29 gyroscope
30 data memory
31 energy store
32 interface
33 radar electrics
100 apparatus
d base distance
d' charge level distance
h charge level
l lowering depth
t blasting borehole depth
z vertical axis

The invention claimed is:

1. A method for measuring blasting boreholes, wherein the method comprises at least the following steps:

providing a radar head having a base body at which a connection means for a pulling means is formed at an upper side and having at least one radar unit that is operated in a non-rock penetrating frequency range;

arranging the radar head on the pulling means;

introducing the radar head into a blasting borehole in that the radar head is lowered into the blasting borehole by gravity from an upper aperture opening of said blasting borehole in an arrangement on the pulling means; and detecting at least one measurement value comprising:

a base distance of the radar head from a blasting borehole base and/or a charge level distance for determining the charge level of the explosive in the blasting borehole, and a shape of a jacket section over at least a portion of a depth of the blasting borehole by means of the operation of at least one of the radar units;

wherein the radar head is moved from bottom to top or from top to bottom in a vertical axis between a lower blasting borehole base and the aperture opening of the blasting borehole during the detection of the at least one measurement value.

2. The method in accordance with claim 1, wherein the pulling means is indirectly guided via at least one rotary encoder or length encoder, with a position of the radar head along a vertical axis being detected by the rotary encoder or length encoder and being output as height information.

3. The method in accordance with claim 1, wherein the at least one radar unit provides distance information by means of a radar-based position determination method, with a position of the radar head along a vertical axis being detected by the radar-based position determination method and being output as height information by means of the radar unit.

4. The method in accordance with claim 1, wherein the at least one measurement value detected by the radar head comprising a charge level of the explosive in the blasting borehole and/or the shape of the jacket section over at least a portion of the depth of the blasting borehole is communicated to a computer unit, with a charge amount or a charge stream of the explosive that is placed into the blasting borehole being determined on the basis of the determined measurement values.

5. The method in accordance with claim 1, wherein a distance of the radar head above the charge level of the explosive is measured by the at least one radar unit, from which a height information of the charge level in the blasting borehole is determined and output in conjunction with a determined position of the radar head along a vertical axis; and/or in that the radar head comprises a rotary unit by which at least one radar beam of at least one radar unit is rotatable about the vertical axis.

6. The method in accordance with claim 1, wherein the detection of the charge level of the explosive in the blasting borehole takes place during charging of the blasting borehole with explosive; and/or with a falling speed of particles forming the explosive being detected by the radar head during the charging of the blasting borehole with explosive.

7. The method in accordance with claim 1, wherein the radar head is designed with a gyroscope.

8. The method in accordance with claim 1, wherein a blasting borehole model is generated by a computer unit on the basis of the determined measurement values comprising the shape of the jacket section over at least a portion of the depth of the blasting borehole.

* * * * *